United States Patent [19]

Wiedmann et al.

[11] Patent Number: 4,828,147

[45] Date of Patent: May 9, 1989

[54] DEVICE FOR TAPPING BEER FROM CONTAINERS, IN PARTICULAR, CANS

[75] Inventors: Helmut Wiedmann, Heilbronn; Joachim Mogler, Austrasse 34, D-7100 Heilbronn, both of Fed. Rep. of Germany

[73] Assignee: Joachim Mogler, Heilbronn, Fed. Rep. of Germany

[21] Appl. No.: 125,322

[22] Filed: Nov. 25, 1987

[30] Foreign Application Priority Data

Nov. 25, 1986 [DE] Fed. Rep. of Germany ..... 3640190

[51] Int. Cl.[4] ..... B65D 83/00

[52] U.S. Cl. ..... 222/82; 222/400.8

[58] Field of Search ..... 222/81–82, 222/89, 394, 399, 400.5, 400.7, 400.8, 401, 464

[56] References Cited

U.S. PATENT DOCUMENTS

| | | | |
|---|---|---|---|
| 341,555 | 5/1886 | Collins et al. | 222/400.7 |
| 2,158,347 | 5/1939 | Yirava | 222/82 X |
| 2,753,080 | 7/1956 | Bartlett | 222/400.8 X |
| 3,372,838 | 3/1968 | Smith et al. | 222/400.7 X |
| 4,095,727 | 6/1978 | Dorsch | 222/400.8 |

*Primary Examiner*—Michael S. Huppert
*Attorney, Agent, or Firm*—Lorusso & Loud

[57] ABSTRACT

A device for tapping beer or the like from cans comprises a housing with an outlet closable by a tapping valve and an air pump. Attached to the housing is a piercing pipe which can be introduced into the can and forms a beer discharge channel which is in communication with the outlet. The air supplied by the air pump flows separately from the beer through lateral air outlet openings of the piercing pipe into the can above the level of the beer and applies pressure to the beer. The flow cross-section of the beer discharge channel in the piercing pipe is determined substantially throughout its entire length by the internal diameter of this pipe. A thin-walled sleeve of smaller external diameter than the internal diameter of the piercing pipe which separates the beer discharge channel from the flow path of the supplied air and which is sealed relative to this channel below the air outlet openings is provided in the upper region only of the piercing pipe.

7 Claims, 2 Drawing Sheets

DEVICE FOR TAPPING BEER FROM CONTAINERS, IN PARTICULAR, CANS

The invention relates to a device for tapping beer from containers, in particular, cans, with a housing which is fixable on the container, with an outlet which is closable by a tapping valve, with an air pump or another gas pressure generator, with a piercing pipe forming a beer discharge channel which is attached to the housing, is introducible into the container and is in communication with the outlet, and with lateral air outlet openings on the piercing pipe, with the air supplied by the air pump being introducible separately from the beer through the piercing pipe out of the air outlet openings into the container above the level of the beer.

In a known tapping device of this kind (German Pat. No. 2,531,697) the piercing pipe comprises as part of the beer discharge channel a thin metal ascending pipe with an internal diameter of approximately 3 mm extending throughout the entire length of the piercing pipe. Since the entire amount of tapped beer flowing out of a comparatively wide outlet end of the beer discharge channel must pass through the relatively narrow and long ascending pipe, the beer has a very high flow rate in this pipe, which results in intensive release of carbon dioxide during the tapping procedure, thereby producing an undesirably high proportion of froth at the outlet end of the beer discharge channel, with the speed at which the beer is tapped being, in all, relatively low.

The object of the invention is to remedy the above-described deficiencies and to so improve a generic tapping device that, at a substantially higher tapping speed, no appreciable froth formation due to liberated carbon dioxide occurs during the tapping procedure.

The object is achieved, in accordance with the invention, by the flow cross-section of the beer discharge channel in the piercing pipe being determined substantially throughout its entire length by the internal diameter of this pipe, and by a thin-walled sleeve of smaller external diameter than the internal diameter of the piercing pipe which separates the beer discharge channel from the flow path of the supplied air and which is sealed relative to this channel below the air outlet openings being provided in the upper region only of the piercing pipe.

The following description of preferred embodiments of the invention serves in conjunction with the appended drawings to explain the invention in greater detail. In the drawings.

Figure 1:
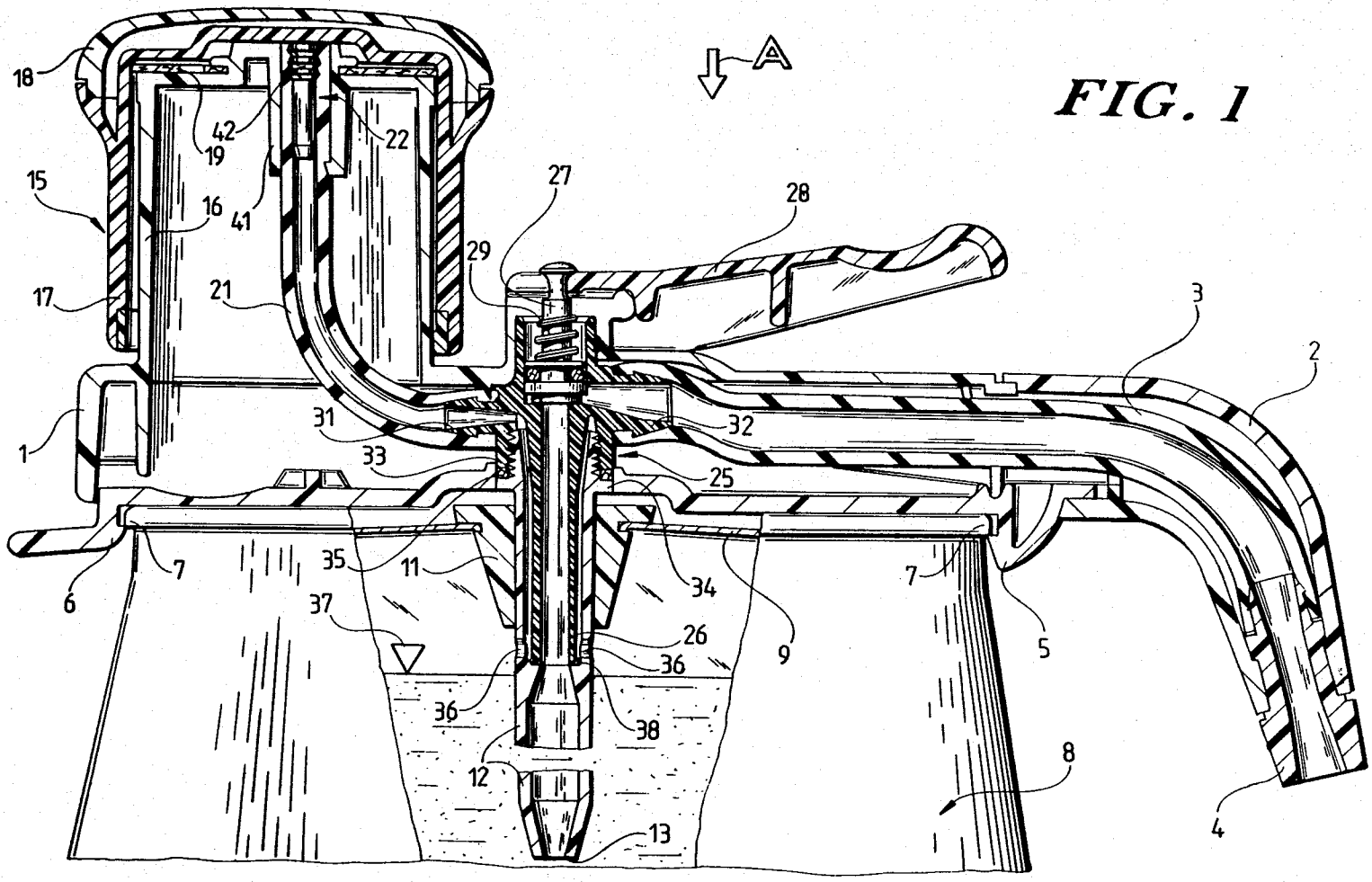
FIG. 1 is a cross-sectional view of a tapping device for beer or other drinks containing carbon dioxide.
Figure 2:
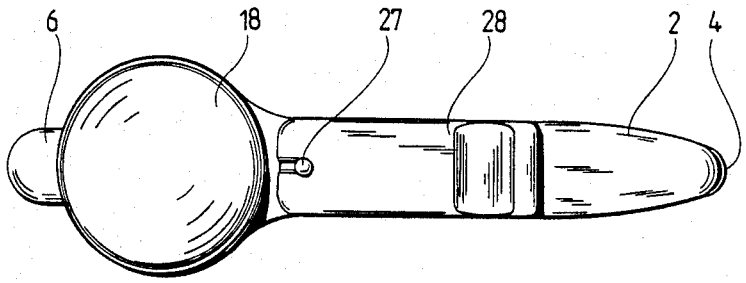
FIG. 2 is a plan view of the device in the direction of arrow A in FIG. 1.

The tapping device shown in FIG. 1 for beer or other drinks containing carbon dioxide comprises a housing 1 with an arm 2 which in FIG. 1 is rightwardly oriented. Extending within the arm 2 is a beer discharge pipe which is formed by a hose 3 and discharges into the open at an outlet end 4 of the arm 2. Arranged on the underside of the housing 1 are a nose 5 which is fixed on the housing and a resiliently movable nose 6 which enables the housing 1 to be clipped in a manner known per se onto the upper edge 7 of a can 8 filled with beer or the like which is sealed on its lid 9 by a stopper 11.

Protruding downwardly from the housing 1 is a piercing pipe 12 whose length corresponds approximately to the height of the can 8. The correspondingly designed stopper 11 is pierced in a manner known per se by this piercing pipe 12. The piercing pipe 12 is subsequently pushed through the stopper 11 until the housing 1 can be clipped onto the can edge 7 by means of the noses 5,6. The bottom opening 13 of the piercing pipe 12 is then located at a short distance above the bottom of the can 8.

The housing 1 furthermore carries on its upper side an air pump 15 with a stationary plunger housing 16 on the outer side of which a hood 17 covering the housing, with a handle 18, is slidingly displaceable. Arranged on the upper side of the plunger housing 16 is a flexible diaphragm 19 of circular disc configuration which rests with its outer edge against the inner side of the hood 17. Provided within the plunger housing 16 is a compressed air pipe, for example, in the form of a hose 21, which is connected to a check valve 22 which is firmly connected to the upper wall of the plunger housing 16.

When the hood 17 over the plunger housing 16 is pushed in the upward direction, the edge of the diaphragm 19 becomes detached from the inner side of the hood 17 and air flows from the outside and from below into the space formed between the upper side of the plunger housing 16 and the inner side of the hood 17. When the hood 17 is pushed downwardly again, the edge of the diaphragm 19 sealingly abuts the hood 17 and the air between the plunger housing 16 and the hood 17 is conveyed through the check valve 22 into the compressed air pipe formed by the hose 21.

Firmly inserted, for example, by an adhesive or screw connection, in the housing 1, is a distributor member 25 which extends freely with a downwardly protruding sleeve 26 into the uppermost region of the piercing pipe 12, thereby forming a relatively wide annular gap between the outer wall of the sleeve and the inner wall of the piercing pipe. The distributor member 25 comprises at the top a tapping valve 27 which is actuatable by way of a tapping lever 28 mounted for swivel motion on the housing. The tapping valve 27 is sealingly pressed against the upper edge of the sleeve 26 by a spring 29. When the tapping lever 28 is depressed, the valve 27 lifts off its seat on the sleeve 26.

The distributor member 25 further comprises a first hose nipple 31 for connection with the hose 21 and a second hose nipple 32 for connection with the hose 3.

As illustrated, the piercing pipe 12 is screwed with an external thread into an internal thread of a collar 33, likewise formed on the distributor member 25, and an annular seal 35 is placed between the collar 33 and a shoulder 34 on the piercing pipe 12.

The piercing pipe 12 comprises lateral air outlet openings 36 which are located below the stopper 11 and above the level 37 of the liquid in the can 8 when the device is in operation. Below these air outlet openings 36, the lower edge of the sleeve 26 is sealed relative to the inner wall of the piercing pipe 12 by an annular seal 38. Accordingly, when the pump 15 is actuated, the air flows into the space between the liquid level 37 and the can lid 9 by way of the hose 21, the nipple 31, the annular space between piercing pipe 12 and sleeve 26 and the air outlet openings 36. Pressure is thereby applied to the liquid in the can from above and the liquid, therefore, rises inside the piercing pipe 12, enters the sleeve 26 and fills it up to the tapping valve 27. During this, the sleeve 26 keeps the air which is introduced and the liquid separate from one another. When the tapping valve 27 is opened by actuation of the lever 28, liquid (beer) travels under the effect of the prevailing air pressure through the hose pipe 3 outwardly into a container which is held ready.

The above-described design of the tapping device has the following advantages over the prior art: a separate narrow ascending pipe extending throughout the entire length of the piercing pipe 12 is eliminated. The cross-section of the beer discharge channel is practically determined by the relatively large internal diameter of the piercing pipe 12, the likewise still relatively large internal diameter of the sleeve 26 and the similarly large diameter of the hose pipe 3. Since the tapped beer does not have to overcome any narrow regions on its way from the can through the piercing pipe 12 and the sleeve 26, it flows in a relatively large quantity but at a low speed to the outlet end 4 of the device. Consequently, the beer releases practically no carbon dioxide as it passes through the piercing pipe 12 and the sleeve 26. It can, therefore, be tapped without forming froth. The froth only forms from the quantity of beer which has already flowed into the container to be filled. The tapping procedure is, therefore, approximately 30% quicker than with devices having the aforementioned narrow ascending pipe.

The following dimensions have proven particularly advantageous:

- internal diameter of the piercing pipe 12: between 8 and 10 mm;
- external diameter of the sleeve 26: between 7.5 and 9.5 mm;
- internal diameter of the sleeve 26: maximum 9 mm.

Particularly preferred values are 9, 8 and 6 mm for the internal diameter of the piercing pipe 12, the external diameter of the sleeve 26 and the internal diameter of this sleeve, respectively.

As illustrated, the annular space between the piercing pipe 12 and the sleeve 26 enabling introduction of the air also has a relatively large cross-sectional area, in contrast with the prior art. Thus, supply of the compressed air is also facilitated and improved.

Figure 3:
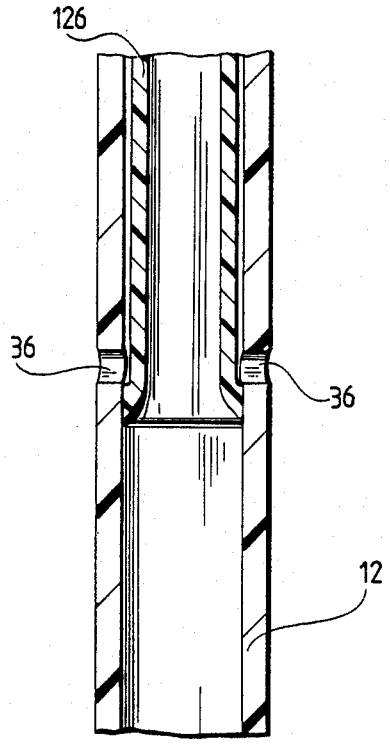
FIG. 3 is a schematic view of a modified embodiment of a distributor sleeve.

In the embodiment of the invention illustrated in FIG. 1, the sleeve 26 forming part of the distributor member 25 is fixedly connected to the housing 1. In another preferred embodiment of the invention, the sleeve 26 which separates air and beer from one another could also be constructed separately from the remaining working parts of the distributor member 25, namely the nipples 31, 32 and the means for accommodating the tapping valve 27. Such an embodiment is shown schematically in FIG. 3. In this case, a sleeve 126 corresponding to the sleeve 26 in FIG. 1 is inserted into the piercing pipe 12 and fixedly and sealingly connected to the pipe 12 below the air outlet openings 26. At the upper (not included in the illustration in FIG. 3) end of piercing pipe 12 and sleeve 126, sealing on the housing 1 of the device is effected in the conventional manner. In other respects, the embodiment according to FIG. 3 functions in the same way as the embodiment according to FIG. 1.

In a further embodiment, the sleeve 126 may also be inserted as a loose intermediate part between piercing pipe 12 and housing 1.

In the last two aforementioned embodiments, the nipples 31,32 and the means for accommodating the tapping valve 27 are then fixedly constructed in a different manner within the housing into which the piercing pipe 12 is also insertable, for example, by a screw connection.

The air pump 15 with the manually displaceable hood 17 described in conjunction with FIG. 1 may also be replaced by a different gas pressure generator, for example, by a carbon dioxide cartridge.

As is apparent from FIG. 1, the hose 21 forming the compressed air feed pipe is arranged, in accordance with the invention, between the nipple 31 of the distributor member 25 and the stationary plunger housing 16 of the air pump 15. The check valve 22 is inserted into this hose 21 at its end facing the plunger housing 16. This results in the advantages that the hose end which contains the check valve 22 is firmly held in a sealed manner in its accommodating means 41 provided for this purpose and, at the same time, the check valve 22 is fixed on the plunger housing 16. Design and assembly of the pump are thereby rendered particularly simple because a separate accommodating means for the check valve 22 which was hitherto necessary is eliminated. The hose 21 may also be replaced by a different compressed air pipe, for example, a rigid pipe.

As illustrated, the check valve 22 comprises several circumferential saw-tooth-type ribs 42 at its upper end for sealing and fixing purposes.

What is claimed is:

1. A device for tapping a beverage containing carbon dioxide from a container comprising:

a main housing, having a center portion, which is capable of being fixed on the container, said main housing comprising a tubular arm, horizontally projecting from said center portion, with inlet and outlet ends, and a plunger housing projecting upward from a portion of said main housing which is offset from said center portion, said main housing, including said tubular arm and plunger housing being manufactured from a single, contiguous material;

a piercing pipe, protruding downwardly from an opening in said main housing center portion and introducible into said container, with lateral air outlet openings and of a specific length approximately equivalent to the height of said container, and piercing pipe defining a beverage discharge channel;

a gas pressure generator compressibly fitted over said plunger housing;

a distributor member threadedly inserted into said main housing, said distributor member comprising a downwardly protruding thin-walled sleeve with top and bottom ends, said sleeve being of smaller external diameter than the internal diameter of the piercing pipe and inserted into said piercing pipe thereby defining an annular gap between the sleeve and the piercing pipe through which supplied air from said gas pressure generator can travel, said sleeve being provided in an upper region only of said piercing pipe and being sealed relative to the beverage discharge channel at a point below said lateral air outlet openings to separate said beer discharge channel from the flow path of the supplied air, said distributor member further comprising a first hose nipple in communication with said annular gap, a second hose nipple in communication with said beverage discharge channel, and a tapping valve sealingly pressed against the top end of said thin-walled sleeve;

a first hose extending through said plunger housing connecting said gas pressure generator to said first hose nipple of said distributor member thereby providing a means by which pressurized gas can be delivered to the inside of said container by traveling through said first hose to said first hose nipple which in turn supplied the pressurized gas to said annular gap so that said pressurized gas can then pass through said lateral openings in said piercing pipe and enter into the container;

a second hose which travels from said distributor member second hose nipple, located at said inlet end of said tubular arm, to said outlet end of said tubular arm, thereby providing a path for said beverage to travel when said tapping valve is opened placing said beverage discharge channel in communication with said second hose nipple; and a tapping lever pivotably mounted on said housing and, when acted upon, able to counteract a spring force in said tapping valve which keeps said tapping valve closed thereby opening said tapping valve.

2. The device as defined in claim 1, wherein the distributor member accommodates the tapping valve.

3. The device as defined in claim 1, wherein the distributor member comprises a collar with an internal thread into which the piercing pipe is screwed by means of a corresponding external thread.

4. The device as defined in claim 1, wherein the internal diameter of the piercing pipe is between 8 and 10 mm, the external diameter of the sleeve is between 7.5 and 9.5 mm and the internal diameter of the sleeve is approximately 9 mm maximum.

5. The device as defined in claim 1, wherein the internal diameter of the piercing pipe is approximately 9 mm, the external diameter of the sleeve is approximately 8 mm and the internal diameter of the sleeve is approximately 6 mm.

6. The device as defined in claim 1, wherein the sleeve is loosely inserted between the housing and the piercing pipe.

7. The device as defined in claim 1, wherein the sleeve is firmly connected to the piercing pipe.

* * * * *